US011247798B2

(12) United States Patent
Yokota

(10) Patent No.: US 11,247,798 B2
(45) Date of Patent: Feb. 15, 2022

(54) BOX PACKING APPARATUS

(71) Applicant: ISHIDA CO., LTD., Kyoto (JP)

(72) Inventor: Yuji Yokota, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 35 days.

(21) Appl. No.: 16/424,509

(22) Filed: May 29, 2019

(65) Prior Publication Data

US 2019/0375526 A1 Dec. 12, 2019

(30) Foreign Application Priority Data

Jun. 11, 2018 (JP) ..... JP2018-111139

(51) Int. Cl.

| | |
|---|---|
| ***B65B 35/18*** | (2006.01) |
| ***B65B 5/04*** | (2006.01) |
| ***B65B 43/48*** | (2006.01) |
| ***B65B 65/00*** | (2006.01) |

(52) U.S. Cl.

CPC ..... *B65B 35/18* (2013.01); *B65B 5/04* (2013.01); *B65B 43/48* (2013.01); *B65B 65/003* (2013.01)

(58) Field of Classification Search

CPC .... B65B 5/04; B65B 5/06; B65B 5/08; B65B 21/06; B65B 21/018; B65B 43/39

USPC ..... 53/473, 248, 251, 497, 539

See application file for complete search history.

(56) References Cited

U.S. PATENT DOCUMENTS 4,457,121 A * 7/1984 Johnson ..... B65B 21/16 53/247
5,044,143 A * 9/1991 Ako ..... B65B 5/108 53/448
5,588,282 A * 12/1996 Hartness ..... B65B 21/183 53/248
5,797,249 A * 8/1998 Hartness ..... B65B 21/183 53/248
6,792,741 B1 * 9/2004 Theriault ..... B65B 5/108 53/241
7,401,453 B2 * 7/2008 Ford ..... B65B 21/242 53/251
7,694,492 B2 * 4/2010 Van Ballegooijen ... B65B 23/02 53/260
7,703,260 B1 * 4/2010 Watkins ..... B65B 43/59 53/250

(Continued)

FOREIGN PATENT DOCUMENTS

DE 102008010432 A1 8/2009
JP 08-183517 A 7/1996

(Continued)

OTHER PUBLICATIONS

The Search Report from the corresponding European Patent Application No. 19179402.3 dated Sep. 6, 2019.

*Primary Examiner* — Valentin Neacsu
*Assistant Examiner* — Jacob A Smith
(74) *Attorney, Agent, or Firm* — Shinjyu Global IP

(57) ABSTRACT

A box packing apparatus is equipped with a first conveyor, a parallel link robot, and a flap folding mechanism. The first conveyor conveys an article. The parallel link robot takes hold of the article on the first conveyor and carries it into a cardboard box that has an upper opening. The flap folding mechanism folds open to the outside of the upper opening at least one of plural cover flaps of the cardboard box that are located around the upper opening.

7 Claims, 17 Drawing Sheets

(56) References Cited

U.S. PATENT DOCUMENTS

| | | | | |
|---|---|---|---|---|
| 8,997,438 | B1 * | 4/2015 | Fallas | B25J 9/107 53/251 |
| 2012/0006651 | A1 * | 1/2012 | Cote | B65B 35/50 198/468.6 |
| 2014/0083062 | A1 * | 3/2014 | Arimatsu | B65B 5/024 53/564 |
| 2015/0298842 | A1 * | 10/2015 | Yokota | B65B 5/04 53/458 |
| 2016/0137326 | A1 * | 5/2016 | Hutter | B65B 21/18 53/473 |
| 2016/0347487 | A1 * | 12/2016 | Minamino | B65B 57/02 |
| 2017/0073097 | A1 * | 3/2017 | Iwasa | B65B 5/061 |

FOREIGN PATENT DOCUMENTS

| | | | | |
|---|---|---|---|---|
| JP | 2012-232380 | A | 11/2012 | |
| WO | WO-2016185862 | A1 * | 11/2016 | B65B 5/08 |

* cited by examiner

BOX PACKING APPARATUS

CROSS-REFERENCE TO RELATED APPLICATIONS

This application claims priority to Japanese Patent Application No. JP2018-111139, filed Jun. 11, 2018. The contents of that application are incorporated by reference in their entirety.

TECHNICAL FIELD

This invention relates to a box packing apparatus that carries articles into boxes.

BACKGROUND ART

Conventionally, box packing apparatus that use a robot to carry articles conveyed thereto by a conveyor or the like into boxes have been used. As the robot that carries the articles into the boxes, a parallel link robot such as the one disclosed in JP-A No. 2012-232380, for example, is used. The parallel link robot is equipped with plural parallel link arms. Lower ends of the parallel link arms are connected to suction pads for sucking and holding the articles. The parallel link robot can control the parallel link arms to move the suction pads in the horizontal direction and the vertical direction.

BRIEF SUMMARY

However, in a parallel link robot, the moving speed and moving range of the suction pads in the vertical direction are small compared to the moving speed and moving range in the horizontal direction. For that reason, in a box packing apparatus that uses a parallel link robot, the moving speed and moving range, in the vertical direction, of the articles that are sucked and held are limited, so it is sometimes difficult to improve the efficiency with which the parallel link robot packs the articles.

It is an object of this invention to provide a box packing apparatus that can efficiently carry articles into boxes using a parallel link robot.

A box packing apparatus pertaining to this invention is equipped with a first conveyor, a parallel link robot, and a flap folding mechanism. The first conveyor conveys an article. The parallel link robot takes hold of the article on the first conveyor and carries it into a box that has an upper opening. The flap folding mechanism folds open to the outside of the upper opening at least one of plural cover flaps of the box that are located around the upper opening.

In this box packing apparatus, the article held by the parallel link robot can be moved over the cover flap that is folded open to the outside and can be carried into the box. For that reason, the vertical stroke of the article held by the parallel link robot is reduced compared to a case where the article held by the parallel link robot is moved over the cover flap that is not folded open to the outside and is carried into the box. Consequently, this box packing apparatus can efficiently carry the article into the box using the parallel link robot.

Furthermore, it is preferred that the parallel link robot move the article it has taken hold of and carry it into the box at a height position above the cover flap that has been folded open and lower than upper ends of the other cover flaps that are not folded open.

In this box packing apparatus, the vertical moving range of the article held by the parallel link robot is limited, so the vertical stroke of the article held by the parallel link robot is reduced.

Furthermore, it is preferred that the flap folding mechanism fold open to the outside of the upper opening a conveyor-side cover flap. The conveyor-side cover flap is the cover flap located in the closest position to the first conveyor when it has been folded open to the outside of the upper opening.

In this box packing apparatus, the cover flap located in the closest position to the first conveyor is folded open to the outside. For that reason, by moving the article held by the parallel link robot over the cover flap located in the closest position to the first conveyor, the vertical stroke of the article held by the parallel link robot is reduced.

Furthermore, it is preferred that the flap folding mechanism also fold open to the outside of the upper opening at least one of the two cover flaps located on both adjacent sides of the conveyor-side cover flap.

In this box packing apparatus, the article held by the parallel link robot can be moved over the cover flaps that are adjacent to the cover flap located in the closest position to the first conveyor, so the horizontal stroke of the article held by the parallel link robot is reduced.

Furthermore, it is preferred that the box packing apparatus be further equipped with a second conveyor. The second conveyor conveys the box in such a way that the vertical position of the conveyor-side cover flap that has been folded open by the flap folding mechanism is the same as, or lower than, the vertical position of the article being conveyed by the first conveyor.

In this box packing apparatus, by limiting the vertical distance between the article on the first conveyor and the box on the second conveyor, the vertical stroke of the article held by the parallel link robot is reduced.

Furthermore, it is preferred that the first conveyor have a conveyance surface on which the article is placed and that the second conveyor convey the box in such a way that the conveyor-side cover flap is positioned under the conveyance surface.

In this box packing apparatus, by limiting the horizontal distance between the article on the first conveyor and the box on the second conveyor, the horizontal stroke of the article held by the parallel link robot is reduced.

Furthermore, it is preferred that the box packing apparatus be further equipped with a first flap regulating member. The first flap regulating member maintains a state in which the cover flap that has been folded open by the flap folding mechanism is folded open to the outside of the upper opening 90 degrees or more with respect to the vertical direction.

In this box packing apparatus, by lowering the height position of the distal end of the cover flap that has been folded open, the vertical stroke of the article held by the parallel link robot is reduced.

Furthermore, it is preferred that the box packing apparatus be further equipped with a second flap regulating member. The second flap regulating member prevents a state in which the cover flap located in the farthest position from the first conveyor when it has been folded open to the outside of the upper opening is folded open 30 degrees or more with respect to the vertical direction.

In this box packing apparatus, even if the article comes free from the parallel link robot and is thrown when the parallel link robot is carrying the article into the box, sometimes the article that has been thrown hits the cover flap located in the farthest position from the first conveyor and falls into the box. Because of this, the occurrence of a problem where the article becomes thrown outside the box is inhibited.

The box packing apparatus pertaining to this invention can efficiently carry articles into boxes using a parallel link robot.

DETAILED DESCRIPTION

An embodiment of this invention will be described with reference to the drawings. The embodiment described below is a specific example of this invention and is not intended to limit the technical scope of this invention.

(1) Overall Configuration of Box Packing Apparatus 100

Figure 1:
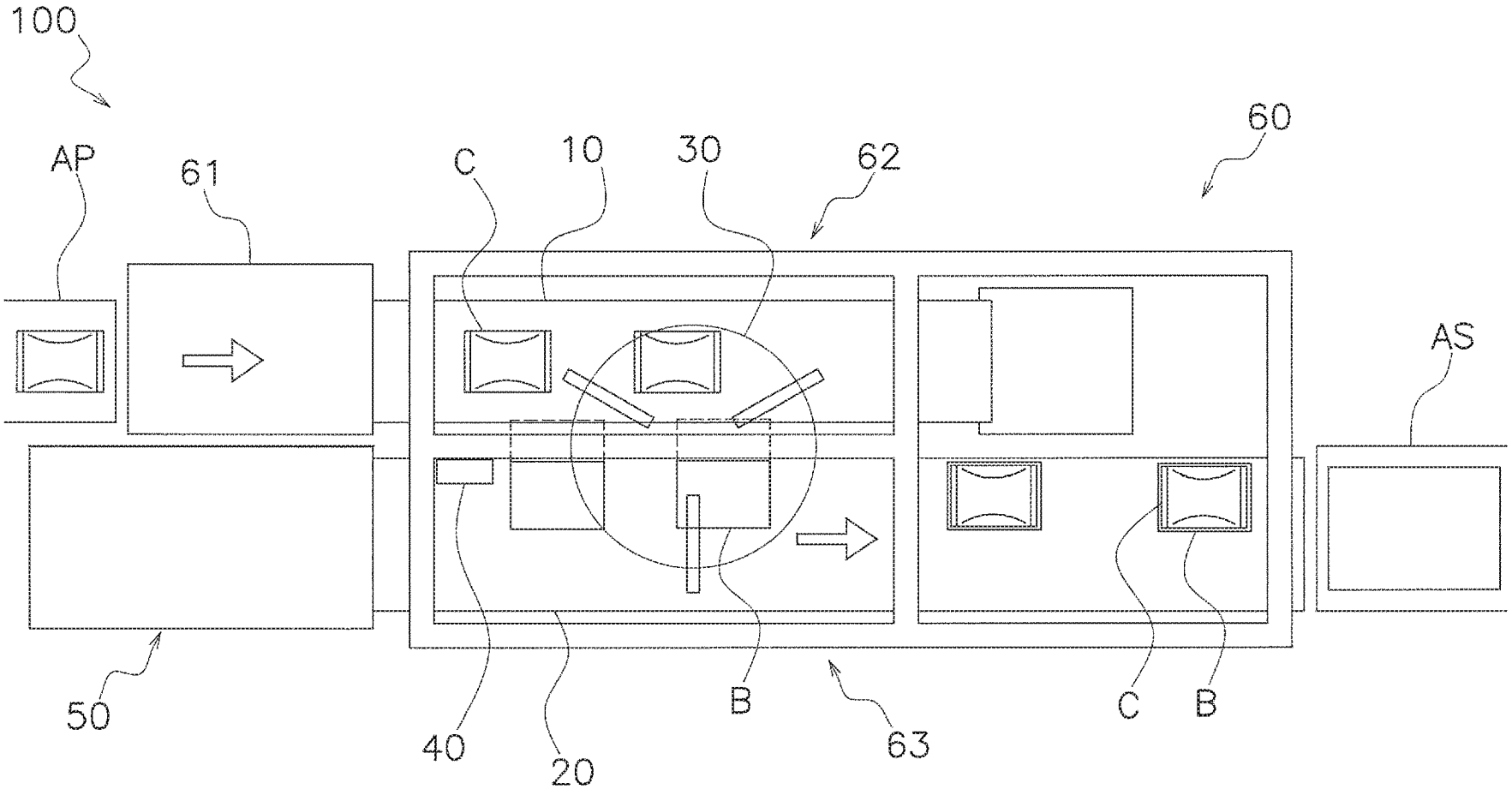
FIG. 1 is a plan view of a box packing apparatus 100 that is an embodiment of this invention.
Figure 2:
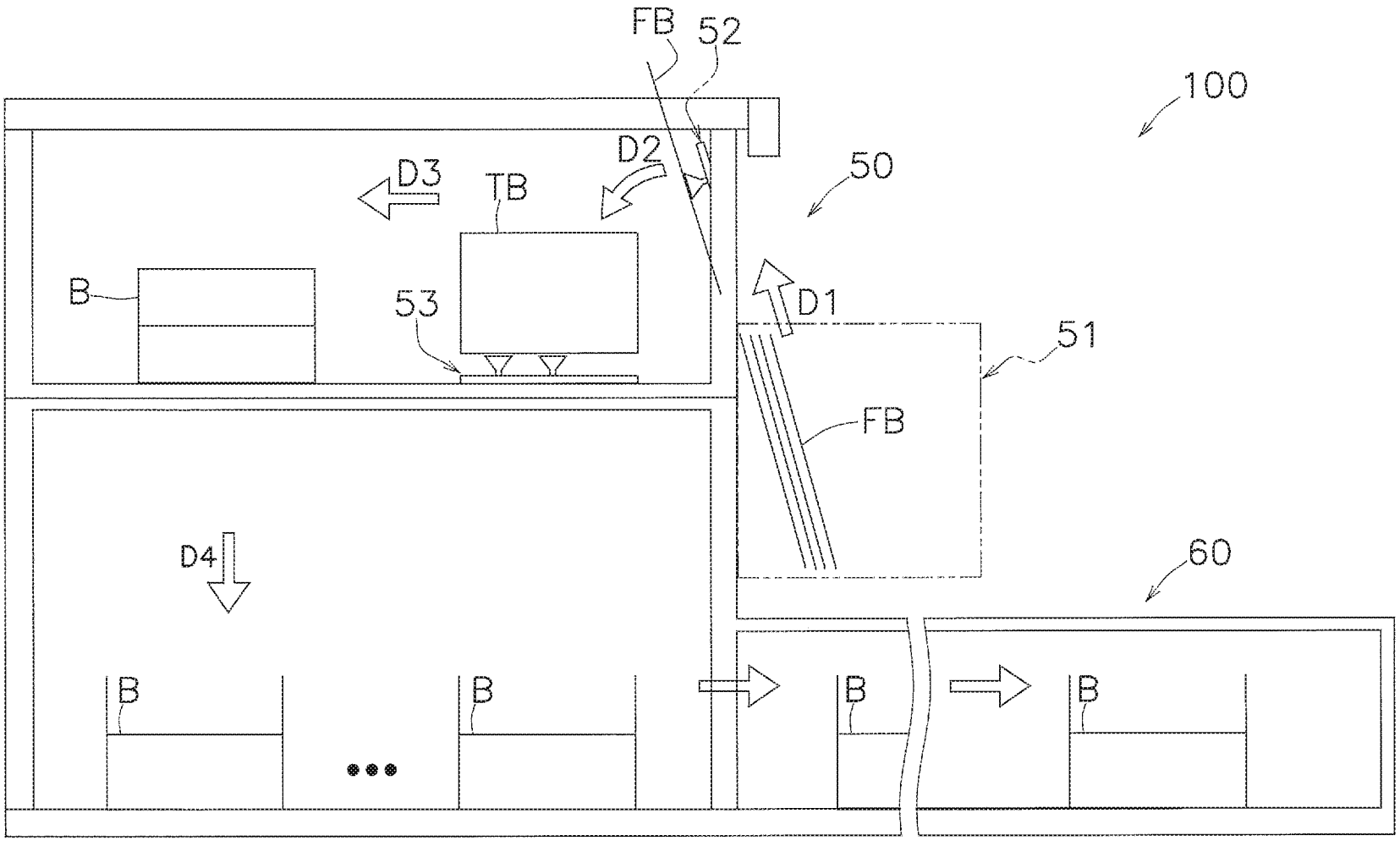
FIG. 2 is a side view of the box packing apparatus 100.

FIG. 1 is a schematic plan view of a box packing apparatus 100 that is an embodiment of this invention. FIG. 2 is a schematic side view of the box packing apparatus 100. The box packing apparatus 100 is, for example, an apparatus that is installed on a production line of a food factory, packs articles C a predetermined number at a time into cardboard boxes B, and seals the cardboard boxes B after the packing. The articles C are, for example, packages in which a food such as potato chips is bagged a predetermined weight at a time. The box packing apparatus 100 has a first conveyor 10, a second conveyor 20, a parallel link robot 30, and a flap folding mechanism 40.

In the production line of the food factory where the box packing apparatus 100 is installed, the articles C are produced by a bag-making and packaging machine (not shown in the drawings) installed on the upstream side of the box packing apparatus 100, undergo a weight inspection and a contamination inspection, for example, and are placed on the first conveyor 10 of the box packing apparatus 100. In the box packing apparatus 100, the articles C being conveyed on the first conveyor 10 are carried by the parallel link robot 30 into cardboard boxes B being conveyed on the second conveyor 20. A weight checker (not shown in the drawings) that inspects the weights of the cardboard boxes B after the sealing is installed on the downstream side of the box packing apparatus 100. The flap folding mechanism 40 folds open a flap of the cardboard boxes B before the articles C are carried into them.

In the box packing apparatus 100, the direction in which the articles C are conveyed by the first conveyor 10 is the same as the direction in which the cardboard boxes B are conveyed by the second conveyor 20. Below, "conveyance direction" means the direction in which the articles C or the cardboard boxes B are conveyed. Furthermore, "upstream" and "downstream" mean upstream and downstream, respectively, in the conveyance direction. In FIG. 1 and FIG. 2, the conveyance direction is indicated by outlined arrows. As shown in FIG. 1, in the box packing apparatus 100, the first conveyor 10 and the second conveyor 20 are disposed in parallel along the conveyance direction.

(2) Detailed Configuration of Box Packing Apparatus 100

The box packing apparatus 100 is configured mainly from a case forming unit 50 and a box packing unit 60. The case forming unit 50 forms the cardboard boxes B. The box packing unit 60 packs a predetermined quantity of the articles C into the cardboard boxes B that have been formed by the case forming unit 50. The operations of the case forming unit 50 and the box packing unit 60 are controlled by a control unit (not shown in the drawings). The control unit is, for example, a microcomputer that controls mechanisms of the case forming unit 50 and the box packing unit 60.

(2-1) Case Forming Unit 50

Figure 3:
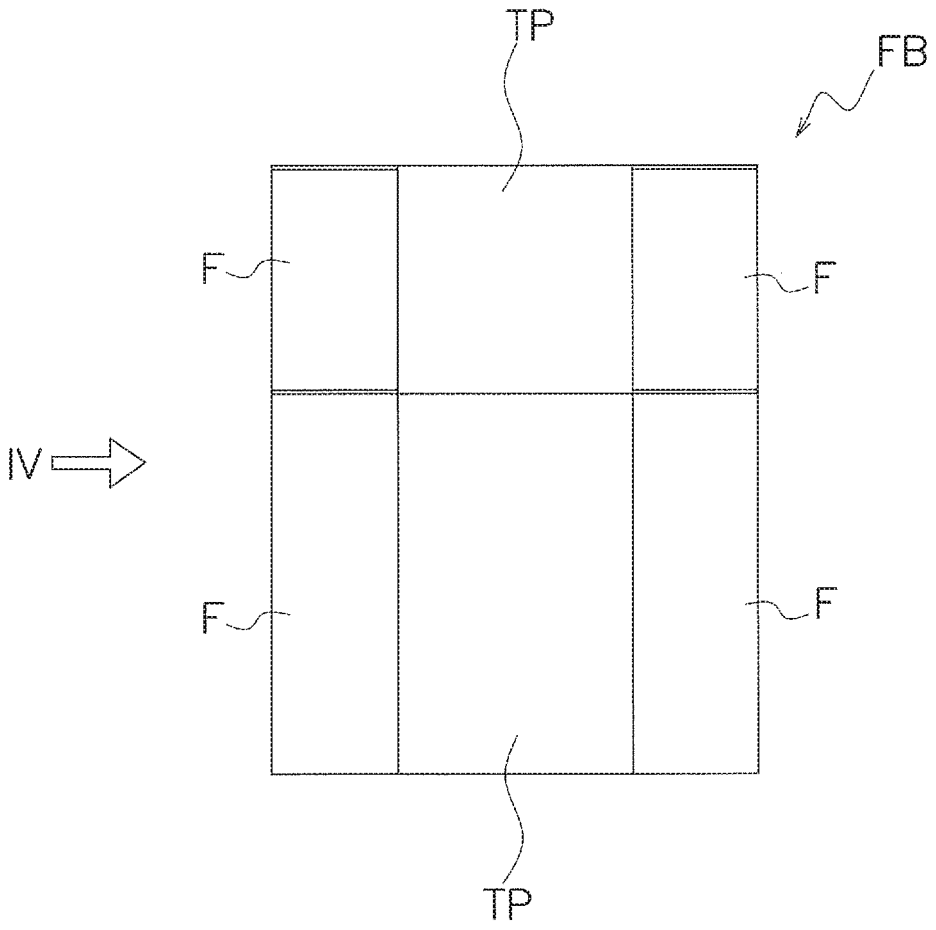
FIG. 3 is a side view of a case forming sheet FB.
Figure 4:
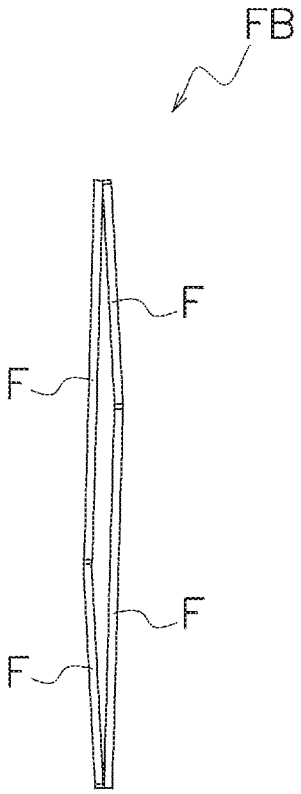
FIG. 4 is a side view of the case forming sheet FB.
Figure 5:
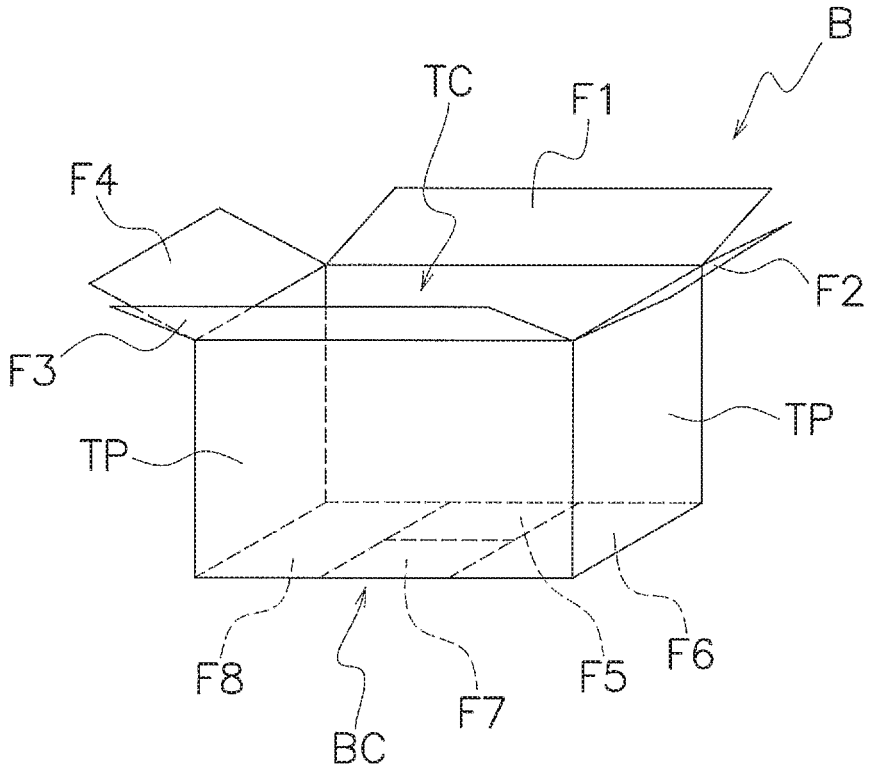
FIG. 5 is a perspective view of a cardboard box B.
Figure 6:
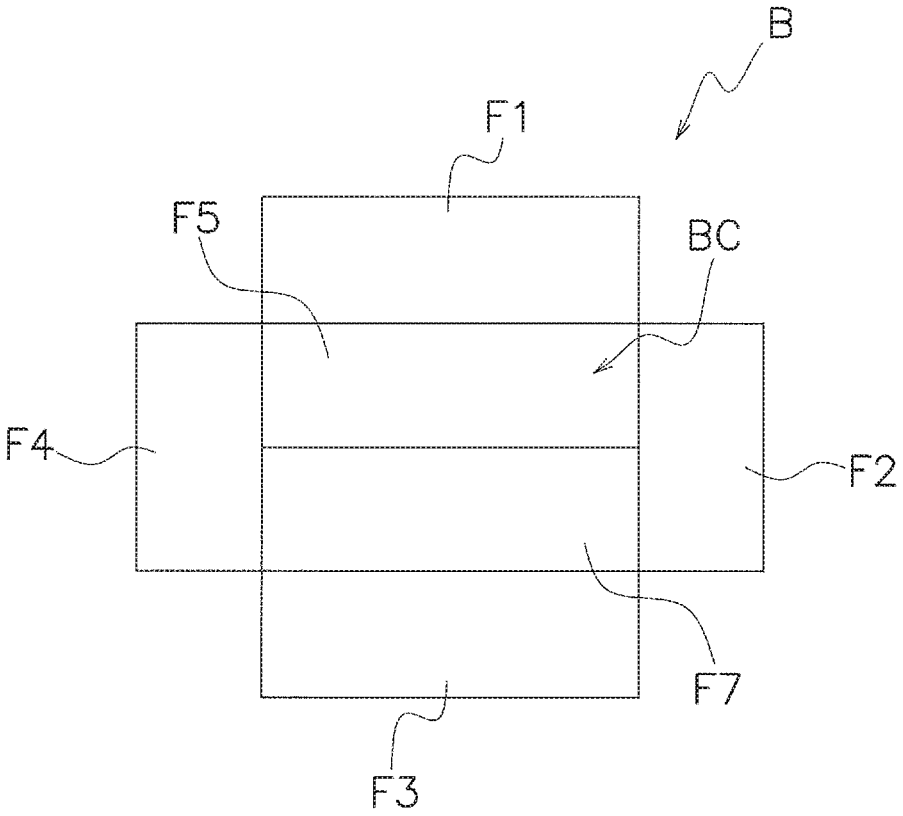
FIG. 6 is a plan view of the cardboard box B as seen from a bottom cover BC.

FIG. 3 and FIG. 4 are side views of a case forming sheet FB. FIG. 4 is a view seen from the direction of arrow IV of FIG. 3. The case forming sheet FB has four side panels TP, which are connected to each other in a loop, and a total of eight flaps F, which are connected to both ends of each side panel TP. FIG. 5 is a perspective view of the cardboard box B before being packed with the articles C. The cardboard box B has the four side panels TP, a bottom cover BC, and four cover flaps F1 to F4. The four cover flaps F1 to F4 are disposed clockwise when the bottom cover BC faces down and the cardboard box B is seen from above. The four cover flaps F1 to F4 are positioned around a rectangular upper opening TC of the cardboard box B. As shown in FIG. 5, the cover flap F1 and the cover flap F3 are provided on the long sides of the upper opening TC, and the cover flap F2 and the cover flap F4 are provided on the short sides of the upper opening TC. FIG. 6 is a plan view of the cardboard box B as seen from the bottom cover BC.

The case forming unit 50 performs a case forming operation in which it forms the cardboard boxes B from the case forming sheets FB. Specifically, the case forming unit 50 opens the case forming sheets FB that are in a collapsed state and folds inward four of the flaps F located on the same side of the side panels TP. The four flaps F that become folded in by the case forming unit 50 are four bottom flaps F5 to F8 that form the rectangular bottom cover BC. The four bottom flaps F5 to F8 are disposed clockwise when the bottom cover BC faces down and the cardboard box B is seen from above. As shown in FIG. 5 and FIG. 6, the bottom flap F5 and the bottom flap F7 are provided on the long sides of the bottom cover BC, and the bottom flap F6 and the bottom flap F8 are provided on the short sides of the bottom cover BC. The case forming unit 50 first folds in the bottom flap F6 and the bottom flap F8 and then folds in the bottom flap F5 and the bottom flap F7. For that reason, as shown in FIG. 6, the bottom flap F5 and the bottom flap F7 are positioned on the outside of the bottom flap F6 and the bottom flap F8.

The four flaps F that were not folded in by the case forming unit 50 are the four cover flaps F1 to F4. At the point in time when the cardboard box B has been formed, the cover flaps F1 to F4 are in an upright state substantially parallel to the side panels TP. FIG. 5 and FIG. 6 show a state in which the cover flaps F1 to F4 are inclined toward the outside of the upper opening TC in order to describe the outer appearance of the cardboard box B in a way that is easier to understand.

The case forming unit 50 has mainly a sheet stacking mechanism 51, a feed mechanism 52, and a case forming mechanism 53. The sheet stacking mechanism 51 stacks a large number of the case forming sheets FB. The feed mechanism 52 sucks, by means of suction cups for example, one of the plural case forming sheets FB stacked in the sheet stacking mechanism 51, pulls it away from the subsequent case forming sheet FB, feeds it upward, and delivers it to the case forming mechanism 53 (see arrow D1 in FIG. 2).

Figure 7:
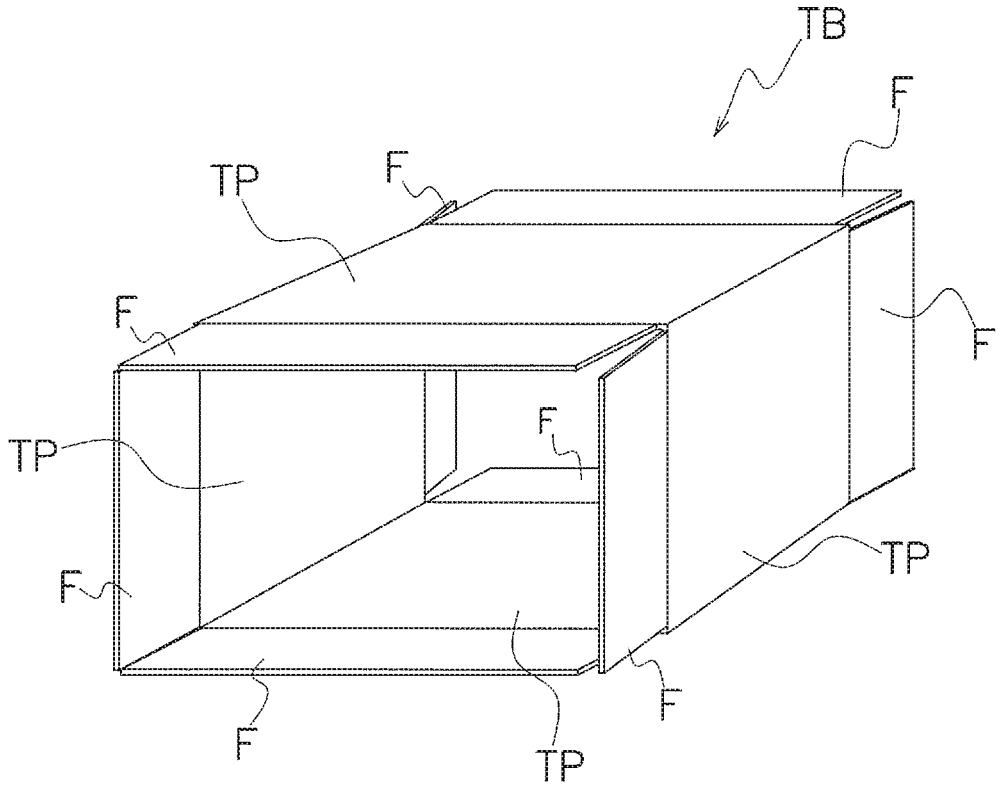
FIG. 7 is a perspective view of a rectangular tube TB.

The case forming mechanism 53 opens the case forming sheet FB that has been delivered from the feed mechanism 52 and forms a rectangular tube TB such as shown in FIG. 7. In other words, the case forming mechanism 53 transforms into a tubular shape the sheet-like case forming sheet FB that has been delivered from the feed mechanism 52 (see arrow D2 in FIG. 2). Next, the case forming mechanism 53 creates the bottom cover BC from four flaps F of the rectangular tube TB to thereby form the cardboard box B (see arrow D3 in FIG. 2). Next, the case forming mechanism 53 sticks adhesive tape for maintaining the shape of the cardboard box B to the bottom cover BC and moves the cardboard box B downward. The cardboard box B thereafter moves (drops) to the box packing unit 60, which is formed under a predetermined drop start position (see arrow D4 in FIG. 2). The drop start position is the place where the cardboard box B is conveyed downward.

(2-2) Box Packing Unit 60

Figure 8:
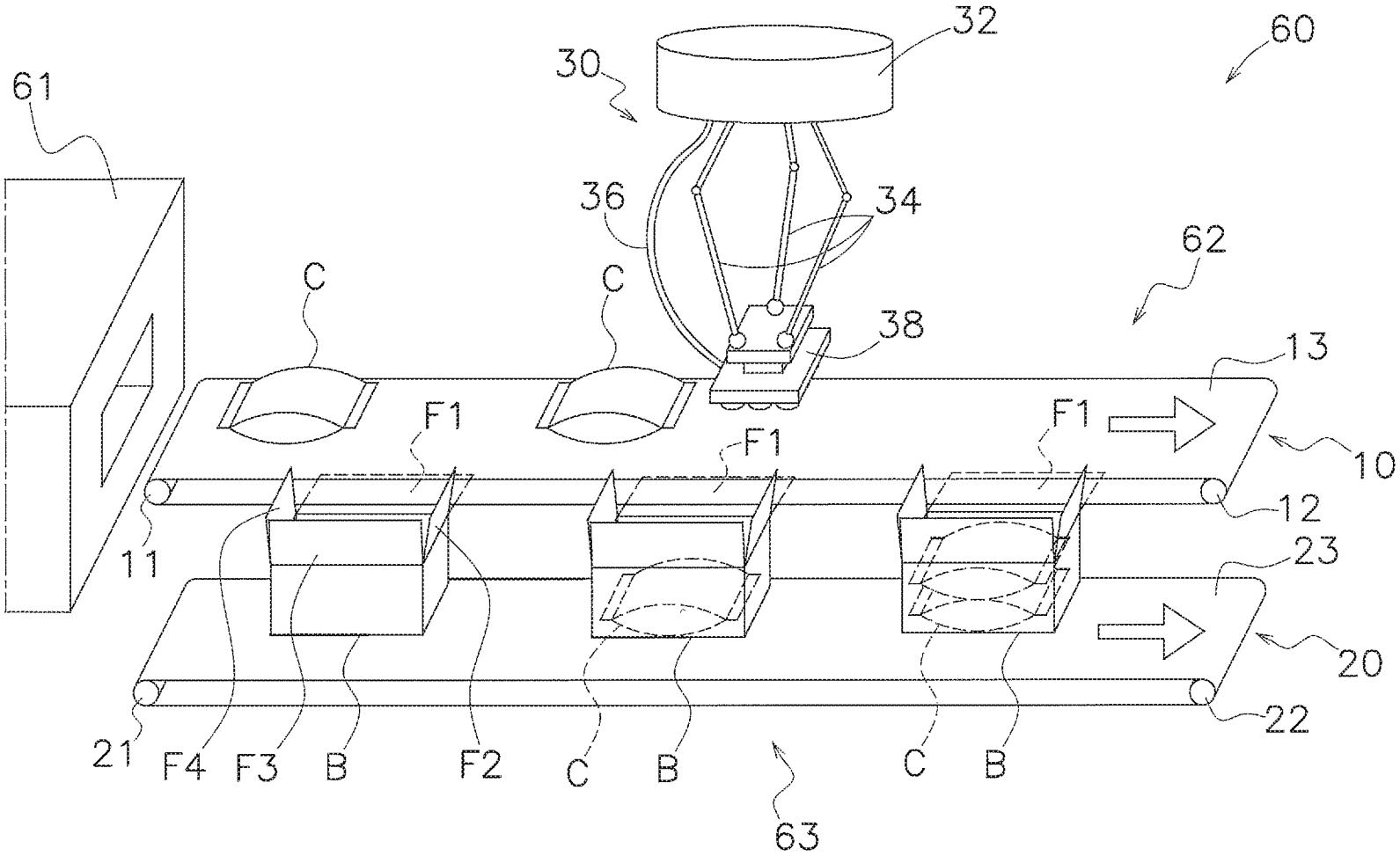
FIG. 8 is a perspective view schematically showing the configuration of a box packing unit 60.
Figure 9:
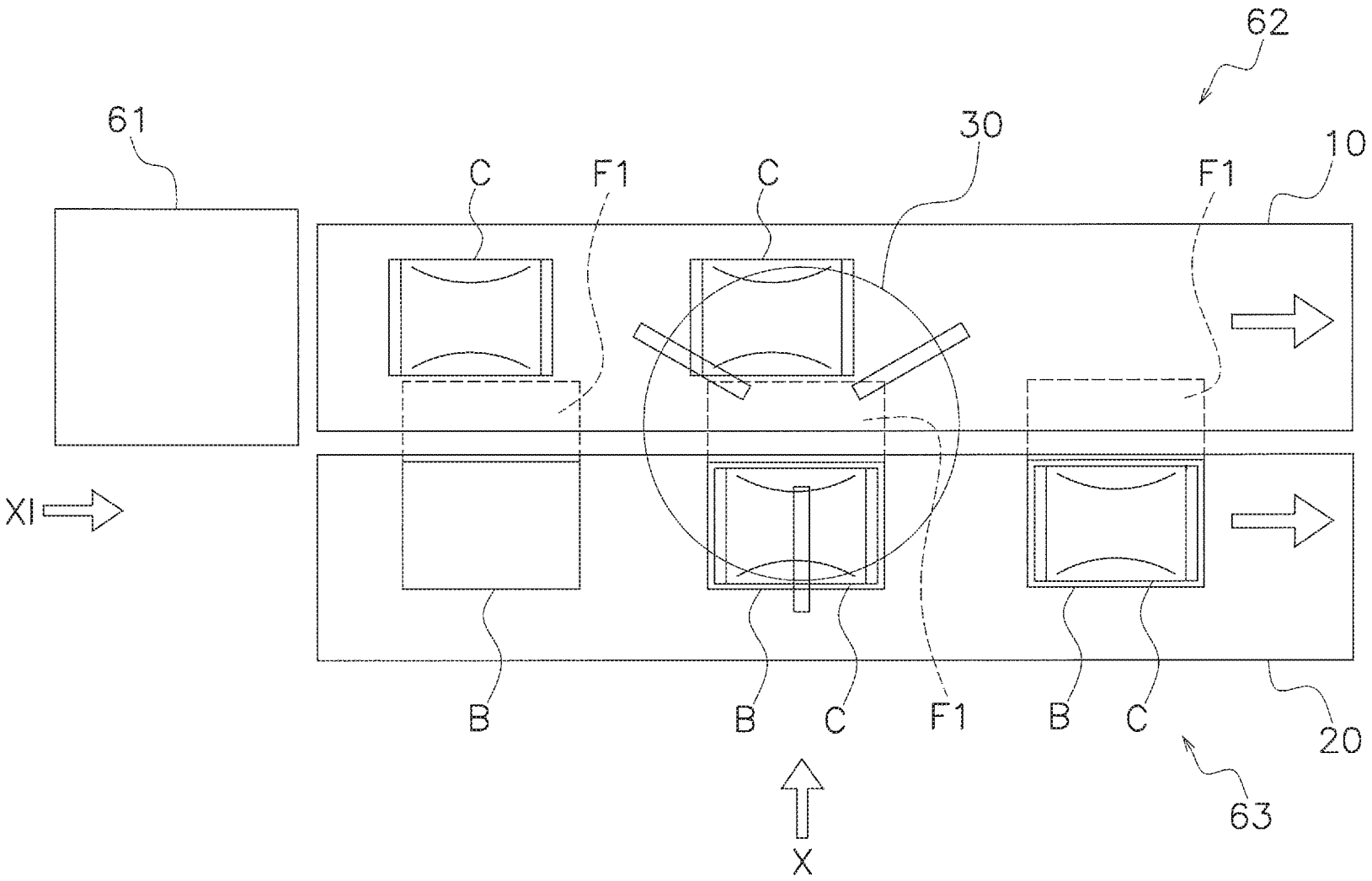
FIG. 9 is a plan view schematically showing the configuration of the box packing unit 60.
Figure 10:
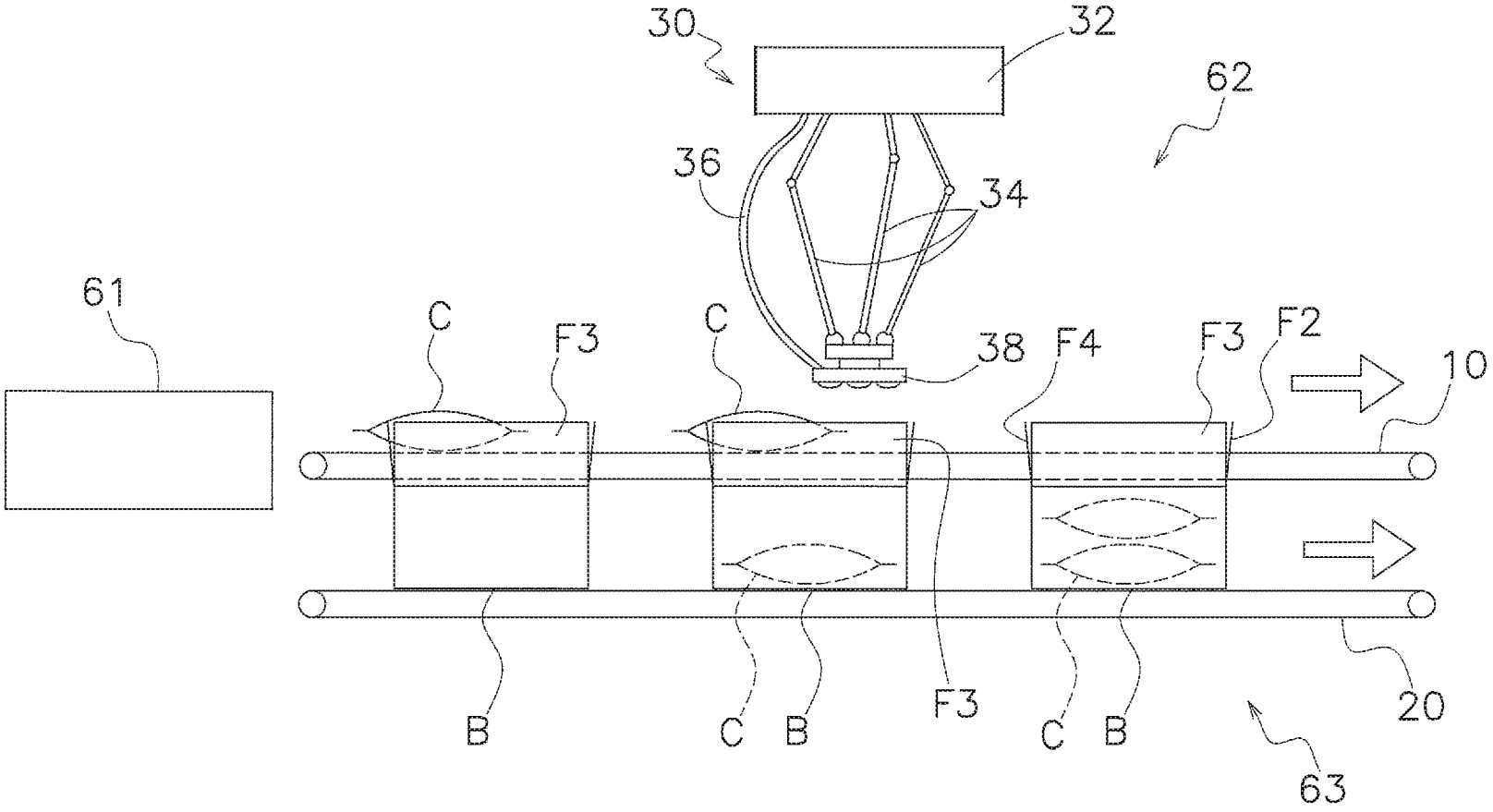
FIG. 10 is a side view schematically showing the configuration of the box packing unit 60.
Figure 11:
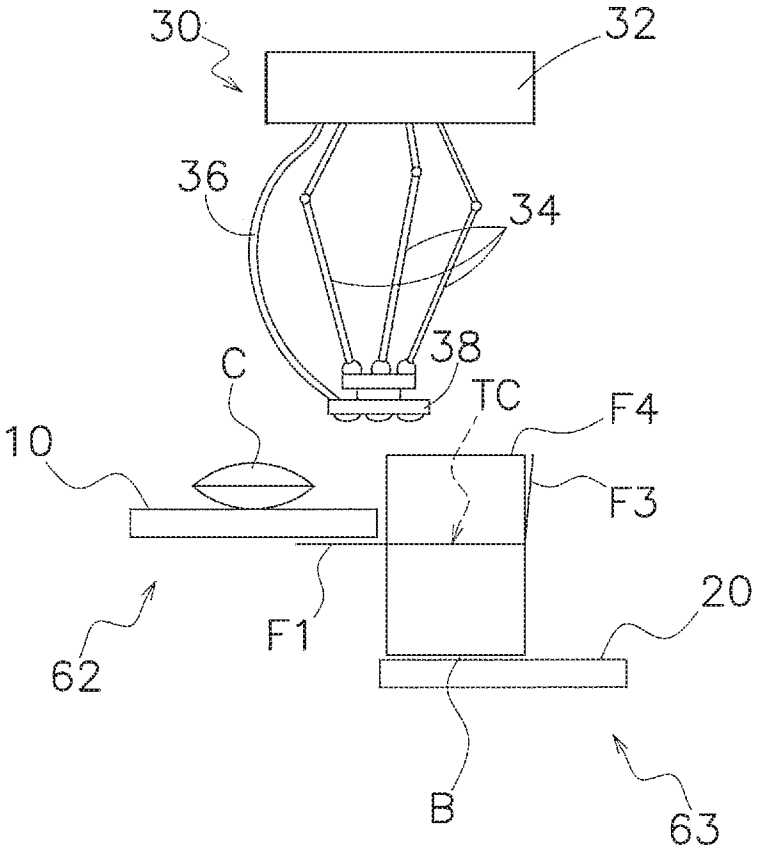
FIG. 11 is a side view schematically showing the configuration of the box packing unit 60.

FIG. 8 is a perspective view schematically showing the configuration of the box packing unit 60. FIG. 9 is a plan view schematically showing the configuration of the box packing unit 60. FIG. 10 and FIG. 11 are side views schematically showing the configuration of the box packing unit 60. FIG. 10 is a side view seen from arrow X of FIG. 9. FIG. 11 is a side view seen from arrow XI of FIG. 9.

The box packing unit 60 packs the articles C conveyed from a preceding-stage apparatus conveyor AP into the cardboard boxes B that have been formed by the case forming unit 50 and delivers the cardboard boxes B that have been packed with the predetermined quantity of the articles C to a subsequent-stage apparatus conveyor AS (see FIG. 1). The box packing unit 60 has mainly a product inspection unit 61, a product handling unit 62, and a box handling unit 63.

(2-2-1) Product Inspection Unit 61

The product inspection unit 61 is provided on the upstream side of the box packing unit 60. The product inspection unit 61 performs an inspection of the articles C that have been conveyed thereto by the preceding-stage apparatus conveyor AP. Specifically, the product inspection unit 61 inspects the weight of the articles C, the state of seals affixed to the articles C, and the presence/absence of contamination. The product inspection unit 61 delivers articles C that have passed the predetermined inspection to the product handling unit 62 and removes articles C that have not passed the predetermined inspection from the production line.

(2-2-2) Product Handling Unit 62

The product handling unit 62 has mainly the first conveyor 10 and the parallel link robot 30. The first conveyor 10 conveys in the conveyance direction the articles C that have been delivered from the product inspection unit 61. The parallel link robot 30 carries into the cardboard boxes B the articles C that have been conveyed thereto by the first conveyor 10.

(2-2-2-1) First Conveyor 10

The articles C that have been delivered from the product inspection unit 61 are placed on the first conveyor 10. As shown in FIG. 10, the first conveyor 10 is a belt conveyor in which a first endless belt 13 bridges a first drive roller 11 and a first follower roller 12. The articles C conveyed by the first conveyor 10 are placed on the upper surface of the first endless belt 13.

The first drive roller 11 is rotated by a drive device (not shown in the drawings) such as a motor, whereby the first follower roller 12 and the first endless belt 13 are driven and the articles C that have been placed on the first endless belt 13 are conveyed in the conveyance direction. The first conveyor 10 conveys the plural articles C in a state in which the plural articles C are arranged in a line along the conveyance direction on the first endless belt 13. The first drive roller 11 is positioned on the upstream side of the first follower roller 12 in the conveyance direction.

The first conveyor 10 conveys the articles C in the conveyance direction from the upstream side of the product handling unit 62 to an effective pickup range of the parallel link robot 30. The effective pickup range is a range on the first endless belt 13 of the first conveyor 10 in which the parallel link robot 30 can pick up the articles C from the first conveyor 10.

(2-2-2-2) Parallel Link Robot 30

Figure 12C:
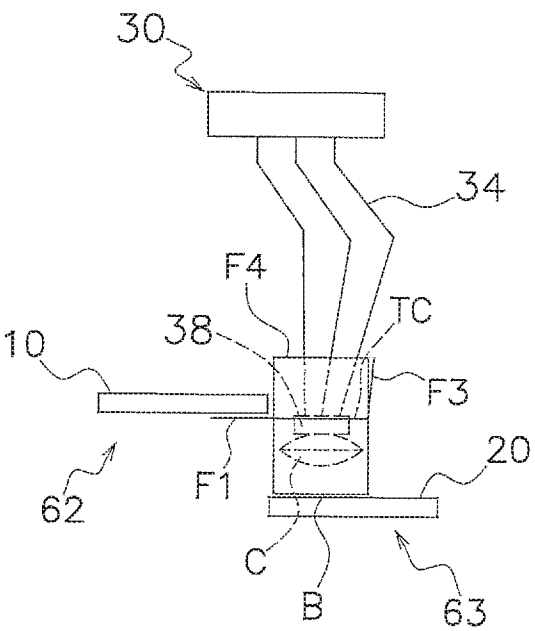
FIG. 12A to FIG. 12C are state transition diagrams of a box packing operation performed by a parallel link robot 30.
Figure 12B:
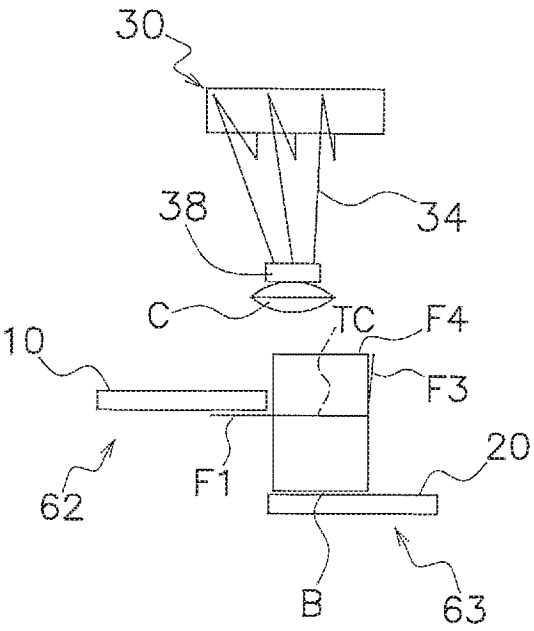
Figure 12A:
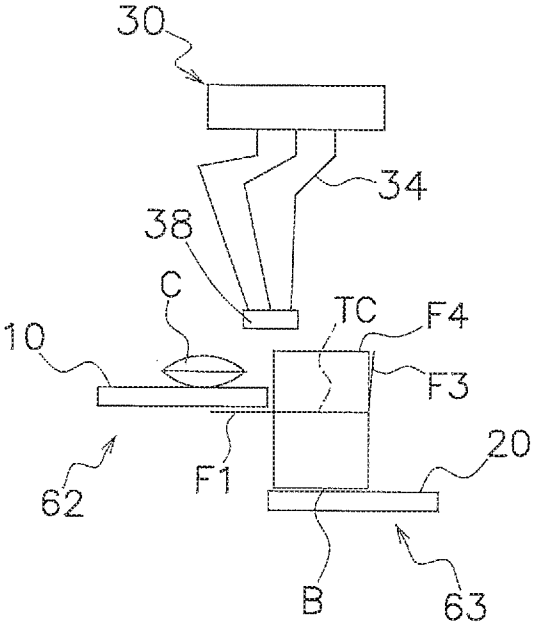

The parallel link robot 30 is a device for performing a box packing operation in which it picks up the articles C from the first conveyor 10 and carries them into the cardboard boxes B that have been conveyed thereto by the box handling unit 63. FIG. 12A to FIG. 12C are state transition diagrams of the box packing operation performed by the parallel link robot 30. FIG. 12A to FIG. 12C are side views seen from the same direction as FIG. 11. The state of the box packing operation transitions in the order of FIG. 12A, FIG. 12B, and FIG. 12C.

The parallel link robot 30, as shown in FIG. 8 and FIG. 12A to FIG. 12C, has three sets of links. The parallel link robot 30 is equipped mainly with a base 32, three parallel link arms 34, and a sucking and holding unit 38.

The base 32, as shown in FIG. 9, is disposed above the first conveyor 10. The base 32 is secured to, for example, a frame of the box packing apparatus 100. The three parallel link arms 34 are each driven by separate servo motors (not shown in the drawings). Upper ends of the three parallel link arms 34 are each connected to output shafts of the servo motors. Lower ends of the three parallel link arms 34 are each connected to the single sucking and holding unit 38 which they share in common. In this way, the three parallel link arms 34 each extend from the output shafts of the servo motors to the sucking and holding unit 38.

The parallel link robot 30 can control the amount of rotation and the direction of rotation of each of the output shafts of the servo motors to move the lower ends of each of the three parallel link arms 34 in the horizontal direction and the vertical direction. Because of this, the parallel link robot 30 can move the sucking and holding unit 38 to arbitrary positions in a predetermined three-dimensional space.

The sucking and holding unit 38 has plural suction pads (not shown in the drawings). The suction pads are attached to the lower portion of the sucking and holding unit 38 and are connected to a suction tube 36 that extends from a vacuum pump and a vacuum blower (not shown in the drawings). The sucking and holding unit 38 can take hold of and release the articles C by switching between a state in which the articles C are sucked and held by the suction pads and a state in which the suction of the articles C is canceled.

The parallel link robot 30 uses the sucking and holding unit 38 to suck and take hold of the articles C on the first conveyor 10 and uses the three parallel link arms 34 to lift up and planarly move the sucking and holding unit 38 that has taken hold of the articles C. Thereafter, the parallel link robot 30 cancels the suction of the articles C by the sucking and holding unit 38 above the second conveyor 20 and carries the articles C into the cardboard boxes B being conveyed on the second conveyor 20. The parallel link robot 30 carries the articles C into the cardboard boxes B through the upper openings TC of the cardboard boxes B. Although the parallel link robot 30 carries the articles C one at a time into the cardboard boxes B, the parallel link robot 30 may also carry the articles C a predetermined quantity at a time as a group into the cardboard boxes B.

The effective pickup range of the parallel link robot 30 is included in a robot movable range, which is the range in which the sucking and holding unit 38 can move. The parallel link robot 30 can take hold of and release the articles C that are in the robot movable range. The parallel link robot 30 can use the sucking and holding unit 38 to hold the articles C located in the effective pickup range on the first conveyor 10 and can carry the articles C that have been taken hold of by the sucking and holding unit 38 into the cardboard boxes B located in an effective packing range on the second conveyor 20.

(2-2-3) Box Handling Unit 63

The box handling unit 63 has mainly the second conveyor 20 and the flap folding mechanism 40. The second conveyor 20 conveys in the conveyance direction the cardboard boxes B that have been delivered from the case forming unit 50. The flap folding mechanism 40 folds open at least one of the four cover flaps F1 to F4 of the cardboard boxes B.

(2-2-3-1) Second Conveyor 20

The cardboard boxes B that have been delivered from the case forming unit 50 are placed on the second conveyor 20 in a state in which their bottom covers BC face down. As shown in FIG. 10, the second conveyor 20 is a belt conveyor in which a second endless belt 23 bridges a second drive roller 21 and a second follower roller 22. The cardboard boxes B conveyed by the second conveyor 20 are placed on the upper surface of the second endless belt 23.

The second drive roller 21 is rotated by a drive device (not shown in the drawings) such as a motor, whereby the second follower roller 22 and the second endless belt 23 are driven and the cardboard boxes B that have been placed on the second endless belt 23 are conveyed in the conveyance direction. The second conveyor 20 conveys the plural cardboard boxes B in a state in which the plural cardboard boxes B are arranged in a line along the conveyance direction on the second endless belt 23. The second drive roller 21 is positioned on the upstream side of the second follower roller 22 in the conveyance direction.

The cardboard boxes B conveyed by the second conveyor 20 have the four cover flaps F1 to F4 around the upper opening TC. As shown in FIG. 9, in the cardboard boxes B conveyed on the second conveyor 20, the longitudinal direction of the upper openings TC is parallel to the conveyance direction and the transverse direction of the upper openings TC is orthogonal to the conveyance direction.

The second conveyor 20 conveys the cardboard boxes B in the conveyance direction from the effective packing range of the parallel link robot 30 to the downstream side of the box handling unit 63. The effective packing range is a range on the second endless belt 23 of the second conveyor 20 in which the parallel link robot 30 can place on the second endless belt 23 the articles C it has picked up from the first conveyor 10.

As shown in FIG. 10 and FIG. 11, the placement surface of the second endless belt 23 of the second conveyor 20 is located in a lower height position than the placement surface of the first endless belt 13 of the first conveyor 10.

(2-2-3-2) Flap Folding Mechanism 40

The flap folding mechanism 40 folds open at least one of the four cover flaps F1 to F4 of the cardboard boxes B. Specifically, the flap folding mechanism 40 folds open, toward the outside of the upper opening TC of the cardboard boxes B, a conveyor-side cover flap F1 that is one of the four cover flaps F1 to F4. The conveyor-side cover flap F1 is the cover flap F1 to F4 located in the closest position to the first conveyor 10 when it has been folded open to the outside of the upper opening TC. Below, what is called upper ends of the cover flaps F1 to F4 means the ends of the cover flaps F1 to F4 located on the opposite side of the ends on the upper opening TC side, regardless of the direction and angle of the cover flaps F1 to F4.

As shown in FIG. 10, when the four cover flaps F1 to F4 have been folded open to the outside of the upper opening TC, the upper end of the cover flap F1 is located in a closer position to the first conveyor 10 than the upper ends of the cover flaps F2 to F4. For that reason, the conveyor-side cover flap F1 is the cover flap F1.

Figure 13:
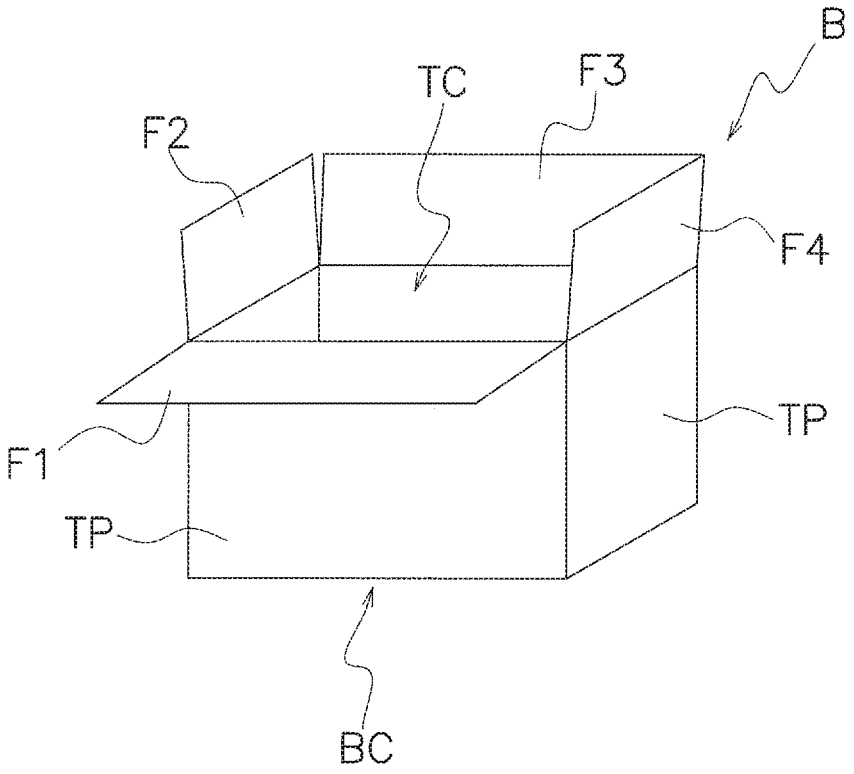
FIG. 13 is a perspective view of the cardboard box B with its conveyor-side cover flap F1 folded open.

The operation of folding open the cover flap F1 to F4 is an operation of folding the interconnecting portion between the cover flap F1 to F4 and the side panel TP so that the upper end of the cover flap F1 to F4 comes to the outside of the upper opening TC. FIG. 13 is a perspective view of the cardboard box B with its conveyor-side cover flap F1 folded open. In FIG. 13, the conveyor-side cover flap F1 is folded open substantially parallel to the bottom cover BC of the cardboard box B. Furthermore, in FIG. 13, the cover flaps F2 to F4 excepting the conveyor-side cover flap F1 are not folded open and are in an upright state substantially parallel to the side panels TP.

The flap folding mechanism 40 has an arbitrary configuration that can fold open the predetermined cover flap F1 to F4. For example, the flap folding mechanism 40 is a metal member that operates at the timing when the cardboard boxes B conveyed on the second conveyor 20 pass through a predetermined position and folds open the predetermined cover flap F1 to F4. In the box handling unit 63, the flap folding mechanism 40 folds open just the conveyor-side cover flap F1. The cardboard boxes B having just their conveyor-side cover flaps F1 folded open by the flap folding mechanism 40 are conveyed further downstream, and the articles C are carried into the cardboard boxes B by the parallel link robot 30.

(3) Operation of Box Packing Apparatus 100

In the box handling unit 63, the cardboard boxes B are conveyed in such a way that the conveyor-side cover flaps F1 that have been folded open by the flap folding mechanism 40 are in the same position as the vertical position of the articles C being conveyed by the first conveyor 10 or are lower than the vertical position of the articles C being conveyed by the first conveyor 10. Specifically, the second conveyor 20 adjusts the position of the cardboard boxes B on the placement surface of the second conveyor 20 in such a way that the conveyor-side cover flaps F1 that have been folded open are positioned under the placement surface (conveyance surface) of the first conveyor 10. Because of this, the conveyor-side cover flaps F1 of the cardboard boxes B conveyed by the second conveyor 20 are positioned under the first conveyor 10. For that reason, when the box packing apparatus 100 is seen in a plan view from above, the conveyor-side cover flaps F1 of the cardboard boxes B conveyed on the second conveyor 20 coincide with the placement surface of the first conveyor 10. The second conveyor 20 conveys the cardboard boxes B in the conveyance direction in a state in which the conveyor-side cover flaps F1 are positioned under the placement surface of the first conveyor 10.

The parallel link robot 30 moves the articles C it has sucked and taken hold of and carries them into the cardboard boxes B at a height position above than the conveyor-side cover flaps F1 that have been folded open and lower than the upper ends of the other cover flaps F2 to F4 that are not folded open. That is, the articles C held by the parallel link robot 30 pass over the conveyor-side cover flaps F1 and are carried into the cardboard boxes B. At this time, the height position of the articles C carried by the parallel link robot 30 is higher than the upper ends of the side panels TP of the cardboard boxes B and lower than the upper ends of the cover flaps F2 to F4 that are upright.

The box packing apparatus 100 can use the parallel link robot 30 to take hold of the articles C being conveyed on the first conveyor 10 and carry them into the cardboard boxes B being conveyed on the second conveyor 20. However, the box packing apparatus 100 may also stop the first conveyor 10 and the second conveyor 20 at predetermined time intervals and use the parallel link robot 30 to take hold of the articles C on the first conveyor 10 and carry them into the cardboard boxes B on the second conveyor 20 while the first conveyor 10 and the second conveyor 20 are stopped.

(4) Characteristics of Box Packing Apparatus 100

(4-1)

The box packing apparatus 100 uses the parallel link robot 30 to take hold of the article C being conveyed on the first conveyor 10 and carries it into the cardboard box B being conveyed on the second conveyor 20. The cardboard box B being conveyed on the second conveyor 20 has the four cover flaps F1 to F4 around the upper opening TC. The conveyor-side cover flap F1 of the four cover flaps F1 to F4 is folded open to the outside of the upper opening TC. The parallel link robot 30 carries the article C it has taken hold of from the side of the conveyor-side cover flap F1 closest to the first conveyor 10 via the upper opening TC into the cardboard box B.

In the box packing apparatus 100, the placement surface of the second conveyor 20 is positioned lower than the placement surface of the first conveyor 10. The height positions of the first conveyor 10 and the second conveyor 20 are adjusted beforehand so that the folded-open conveyor-side cover flap F1 of the cardboard box B being conveyed on the second conveyor 20 is positioned lower than the placement surface of the first conveyor 10. When the parallel link robot 30 carries the article C it has taken hold of into the cardboard box B, the parallel link robot 30 planarly moves the article C it has taken hold of at a height position above the conveyor-side cover flap F1 that has been folded open and lower than the upper ends of the other cover flaps F2 to F4 that are not folded open.

The parallel link robot 30 needs to lift up the article C after sucking and taking hold of the article C from the first conveyor 10 and also needs to lower the article C it has sucked and taken hold of when putting the article C into the cardboard box B. If the conveyor-side cover flap F1 were, like the other cover flaps F2 to F4, not folded open, that is, if the conveyor-side cover flap F1 were upright substantially parallel to the side panels TP, the parallel link robot 30 would need to ensure to a certain extent the vertical stroke (moving distance during one box packing operation) of the article C it has taken hold of Specifically, in order to move, over the upper opening TC, the article C that the parallel link robot 30 has sucked and taken hold of from the first conveyor 10, the parallel link robot 30 would need to lift up the article C a distance at least equal to the vertical dimension of the conveyor-side cover flap F1. Likewise, when canceling the suction and holding of the article C in the cardboard box B (the inside of the upper opening TC), the parallel link robot 30 would need to lower the article C a distance at least equal to the vertical dimension of the conveyor-side cover flap F1 in order to reduce the shock that the article C sustains because of the drop.

In this way, if the conveyor-side cover flap F1 is upright when the parallel link robot 30 carries the article C from the side of the conveyor-side cover flap F1, the vertical stroke of the article C held by the parallel link robot 30 becomes longer an amount equal to the vertical dimension of the conveyor-side cover flap F1. However, in the box packing apparatus 100, the conveyor-side cover flap F1 of the cardboard box B is folded open to the outside of the upper opening TC, so compared to a case where the conveyor-side cover flap F1 is upright, the range that the conveyor-side cover flap F1 occupies in the vertical direction is reduced. For that reason, in order to move, over the upper opening TC, the article C that the parallel link robot 30 has sucked and taken hold of from the first conveyor 10, the parallel link robot 30 does not need to lift up the article C a distance equal to the vertical dimension of the upright conveyor-side cover flap F1. That is, because the conveyor-side cover flap F1 is folded open beforehand by the flap folding mechanism 40, the vertical stroke of the article C held by the parallel link robot 30 is reduced.

In a typical parallel link robot, the moving speed and moving range of the suction pads in the vertical direction are small compared to the moving speed and moving range in the horizontal direction. For that reason, the longer the vertical stroke of the suction pads is, the more difficult it becomes to improve the efficiency with which the parallel link robot packs the articles. However, in the box packing apparatus 100, when carrying the article C into the cardboard box B, at least the conveyor-side cover flap F1 is folded open by the flap folding mechanism 40, so the vertical stroke of the article C held by the parallel link robot 30 is reduced. Consequently, the box packing apparatus 100 can efficiently carry the article C into the cardboard box B using the parallel link robot 30.

(4-2)

The box packing apparatus 100 can reduce the vertical stroke of the article C held by the parallel link robot 30 by folding open beforehand at least the conveyor-side cover flap F1 with the flap folding mechanism 40. For that reason, in the box packing apparatus 100, other mechanisms for reducing the vertical stroke of the article C held by the parallel link robot 30 become unnecessary. Such mechanisms are, for example, up-down position changing mechanisms attached to the lower ends of the three parallel link arms 34 of the parallel link robot 30. The up-down position changing mechanisms are mechanisms for changing the vertical position of the article C while sucking and holding the article C. However, the up-down position changing mechanisms have heavy objects such as motors as parts, so the allowable work weight of the parallel link robot 30 becomes limited in correspondence to the weight of the up-down position changing mechanisms. When the allowable work weight becomes limited, there are the concerns that the weight of the article C will be limited and that the number of the articles C that can be carried at one time into the cardboard boxes B will be limited, thereby lowering the efficiency with which the parallel link robot 30 packs the articles C.

However, the box packing apparatus 100 does not require up-down position changing mechanisms or the like for the parallel link robot 30. Instead, the box packing apparatus 100 can reduce the vertical stroke of the article C held by the parallel link robot 30 by folding open at least the conveyor-side cover flap F1 with the flap folding mechanism 40. Consequently, the box packing apparatus 100, using a relatively simple mechanism such as the flap folding mechanism 40, can efficiently carry the article C into the cardboard box B using the parallel link robot 30.

(4-3)

In the box packing apparatus 100, the second conveyor 20 conveys the cardboard box B in the conveyance direction in a state in which the conveyor-side cover flap F1 is positioned under the placement surface of the first conveyor 10. For that reason, as shown in FIG. 9, when the box packing apparatus 100 is seen in a plan view from above, the upper opening TC of the cardboard box B conveyed on the second conveyor 20 can be brought closer to the first conveyor 10. Because of this, the horizontal distance between the article C conveyed on the first conveyor 10 and the cardboard box B conveyed on the second conveyor 20 can be shortened compared to a state in which the conveyor-side cover flap F1 is not positioned under the placement surface of the first conveyor 10. The shorter the horizontal distance is between the article C and the cardboard box B, the more the horizontal stroke of the article C held by the parallel link robot 30 is reduced. Consequently, the box packing apparatus 100 can efficiently carry the article C into the cardboard box B using the parallel link robot 30.

(4-4)

In the box packing apparatus 100, the flap folding mechanism 40 folds open just the conveyor-side cover flap F1 of the cardboard box B. That is, the cover flaps F2 to F4 excepting the conveyor-side cover flap F1 of the cardboard box B conveyed on the second conveyor 20 are not folded open and are in an upright state. Below, the cover flap F3 located across the upper opening TC on the opposite side of the conveyor-side cover flap F1 will be called "the opposite-side cover flap F3."

In the box packing apparatus 100, the parallel link robot 30 uses the sucking and holding unit 38 to take hold of the article C being conveyed on the first conveyor 10. The article C held by the parallel link robot 30 moves in the horizontal direction from the first conveyor 10 toward the second conveyor 20. Furthermore, the height position of the article C held by the parallel link robot 30 is in a lower position than the upper ends of the cover flaps F2 to F4 excepting the conveyor-side cover flap F1.

If the moving speed of the article C held by the parallel link robot 30 is increased in order to improve the efficiency with which the parallel link robot 30 packs the article C, there is the concern that the article C being sucked by the sucking and holding unit 38 will come free from the sucking and holding unit 38. However, even if the article C comes free from the sucking and holding unit 38 during the movement, the article C is thrown toward the opposite-side cover flap F3 that is upright, so there is the possibility that the article C that has been thrown will hit the opposite-side cover flap F3 and fall into the cardboard box B. Furthermore, if some of the suction of the article C in the sucking and holding unit 38 does not hold, there is the possibility that the article C will be sucked again by the sucking and holding unit 38 as a result of the article C hitting the opposite-side cover flap F3. Consequently, the box packing apparatus 100 can reduce the occurrence of problems such as the article C dropping outside the cardboard box B and the article C coming free from the parallel link robot 30.

(5) Example Modifications

An embodiment of this invention has been described above, but this invention is not limited to the above embodiment and is capable of various changes in a range that does not depart from the spirit of the invention.

(5-1) Example Modification A

In the above embodiment, by folding open at least the conveyor-side cover flap F1 with the flap folding mechanism 40, the box packing apparatus 100 can reduce the vertical stroke of the article C held by the parallel link robot 30. However, the flap folding mechanism 40 may fold open not only the conveyor-side cover flap F1 but also other of the flaps F2 to F4 to the outside of the upper opening TC.

For example, the flap folding mechanism 40 may also fold open at least one of the two cover flaps F2 and F4 located on both adjacent sides of the conveyor-side cover flap F1. The two cover flaps F2 and F4 are lined up along the conveyance direction of the cardboard box B. Below, the cover flap F2 on the downstream side in the conveyance direction will be called "the downstream-side cover flap F2" and the cover flap F4 on the upstream side in the conveyance direction will be called "the upstream-side cover flap F4."

In this example modification, for example, the flap folding mechanism 40 may fold open the conveyor-side cover flap F1, the downstream-side cover flap F2, and the upstream-side cover flap F4. In this case, when the parallel link robot 30 carries the article C it has taken hold of into the cardboard box B, the parallel link robot 30 can move the article C it has taken hold of and carry it into the cardboard box B at a height position above the conveyor-side cover flap F1, the downstream-side cover flap F2, and the upstream-side cover flap F4 that have been folded open.

For that reason, as described below, the parallel link robot 30 can carry the article C it has taken hold of into the cardboard box B also from the sides of the downstream-side cover flap F2 and the upstream-side cover flap F4. Specifically, the parallel link robot 30 can carry the article C not only from a direction orthogonal to the conveyance direction (the side of the conveyor-side cover flap F1) but also from directions inclined with respect to the conveyance direction (the sides of the downstream-side cover flap F2 and the upstream-side cover flap F4). Because of this, sometimes the horizontal stroke of the article C held by the parallel link robot 30 is reduced.

Figure 14:
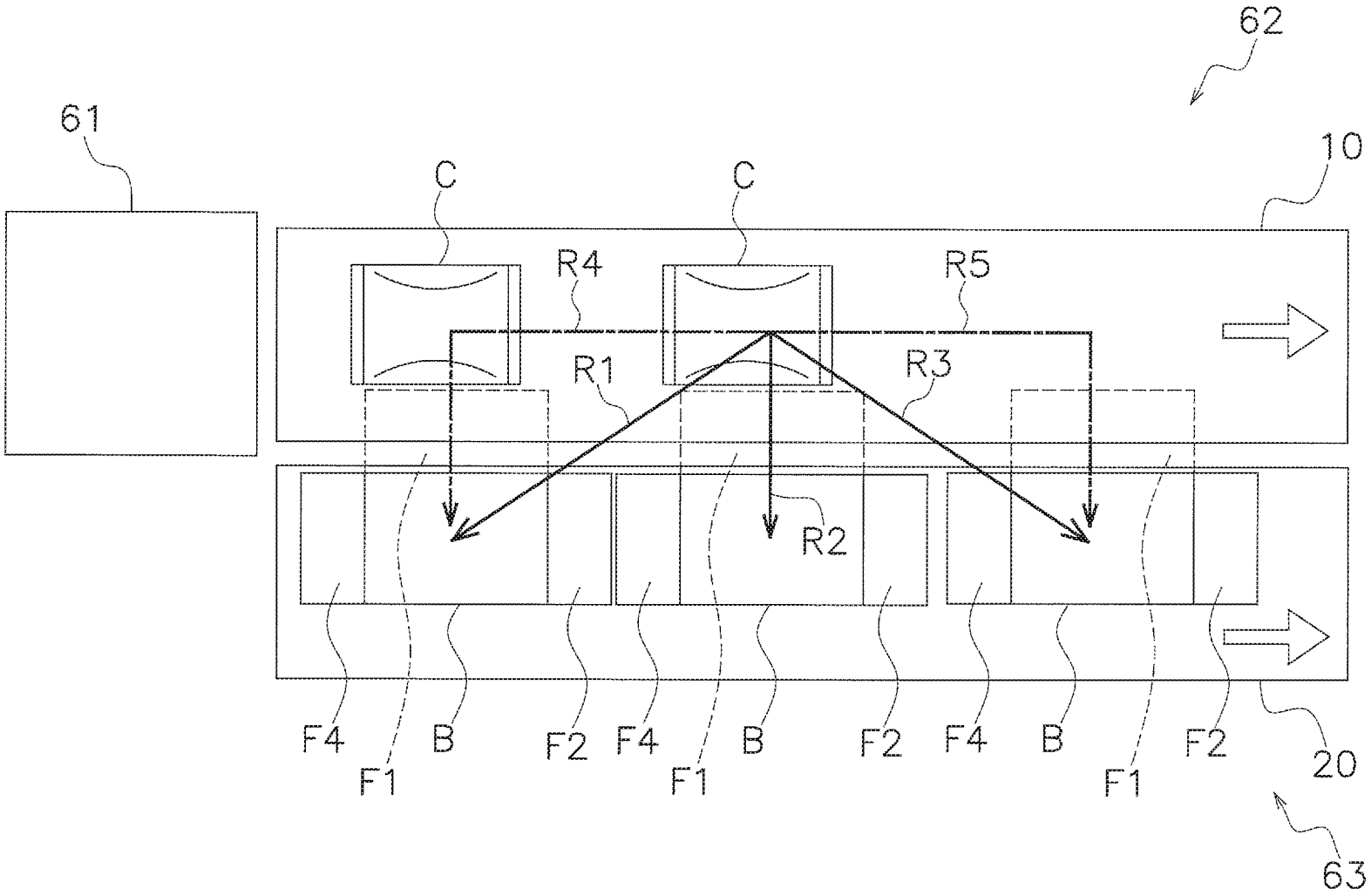
FIG. 14 is a drawing for describing horizontal moving paths of an article C carried into the cardboard box B in example modification A.

FIG. 14 is the same plan view as FIG. 9 and is for describing horizontal moving paths of the article C carried into the cardboard box B. FIG. 14 shows, as horizontal moving paths of the article C, a first moving path R1, a second moving path R2, and a third moving path R3 depending on the position of the cardboard box B. In FIG. 14 the position in the conveyance direction at which the article C on the first conveyor 10 is taken hold of by the parallel link robot 30 is fixed.

Below, as shown in FIG. 14, the conveyor-side cover flap F1, the downstream-side cover flap F2, and the upstream-side cover flap F4 of the cardboard box B are folded open. In a case where the cardboard box B is located on the upstream side of the second conveyor 20, the first moving path R1 is the path along which the article C moves over the conveyor-side cover flap F1 and the downstream-side cover flap F2. In a case where the cardboard box B is located in the middle of the second conveyor 20 (more specifically, in the neighborhood of the base 32), the second moving path R2 is the path along which the article C moves over the conveyor-side cover flap F1. In a case where the cardboard box B is located on the downstream side of the second conveyor 20, the third moving path R3 is the path along which the article C moves over the conveyor-side cover flap F1 and the upstream-side cover flap F4.

In this way, by folding open not only the conveyor-side cover flap F1 but also the downstream-side cover flap F2 and the upstream-side cover flap F4, the parallel link robot 30 can carry the article C into the cardboard box B by way of paths that pass over the downstream-side cover flap F2 or the upstream-side cover flap F4. In FIG. 14, if the downstream-side cover flap F2 and the upstream-side cover flap F4 are not folded open, the parallel link robot 30 needs to move the article C along a fourth moving path R4 instead of the first moving path R1 and to move the article C along a fifth moving path R5 instead of the third moving path R3. The fourth moving path R4 is a path that passes over just the conveyor-side cover flap F1 and is longer than the first moving path R1. The fifth moving path R5 is a path that passes over just the conveyor-side cover flap F1 and is longer than the third moving path R3. For that reason, by folding open the downstream-side cover flap F2 and the upstream-side cover flap F4, the horizontal stroke of the article C held by the parallel link robot 30 can be reduced.

Thus, this example modification, as shown in FIG. 14, can reduce the horizontal stroke of the article C held by the parallel link robot 30 when the parallel link robot 30 carries the article C while the cardboard box B is conveyed in the conveyance direction by the second conveyor 20. Consequently, the box packing apparatus 100 can more efficiently carry the article C into the cardboard box B using the parallel link robot 30.

(5-2) Example Modification B

In the above embodiment, in the box packing apparatus 100, the first conveyor 10 and the second conveyor 20 are disposed in parallel along the conveyance direction. However, the first conveyor 10 and the second conveyor 20 do not need to be disposed in parallel along the conveyance direction. For example, the first conveyor 10 and the second conveyor 20 may also be disposed in such a way that the conveyance direction of the articles C on the first conveyor 10 and the conveyance direction of the cardboard boxes B on the second conveyor 20 intersect each other.

Figure 15:
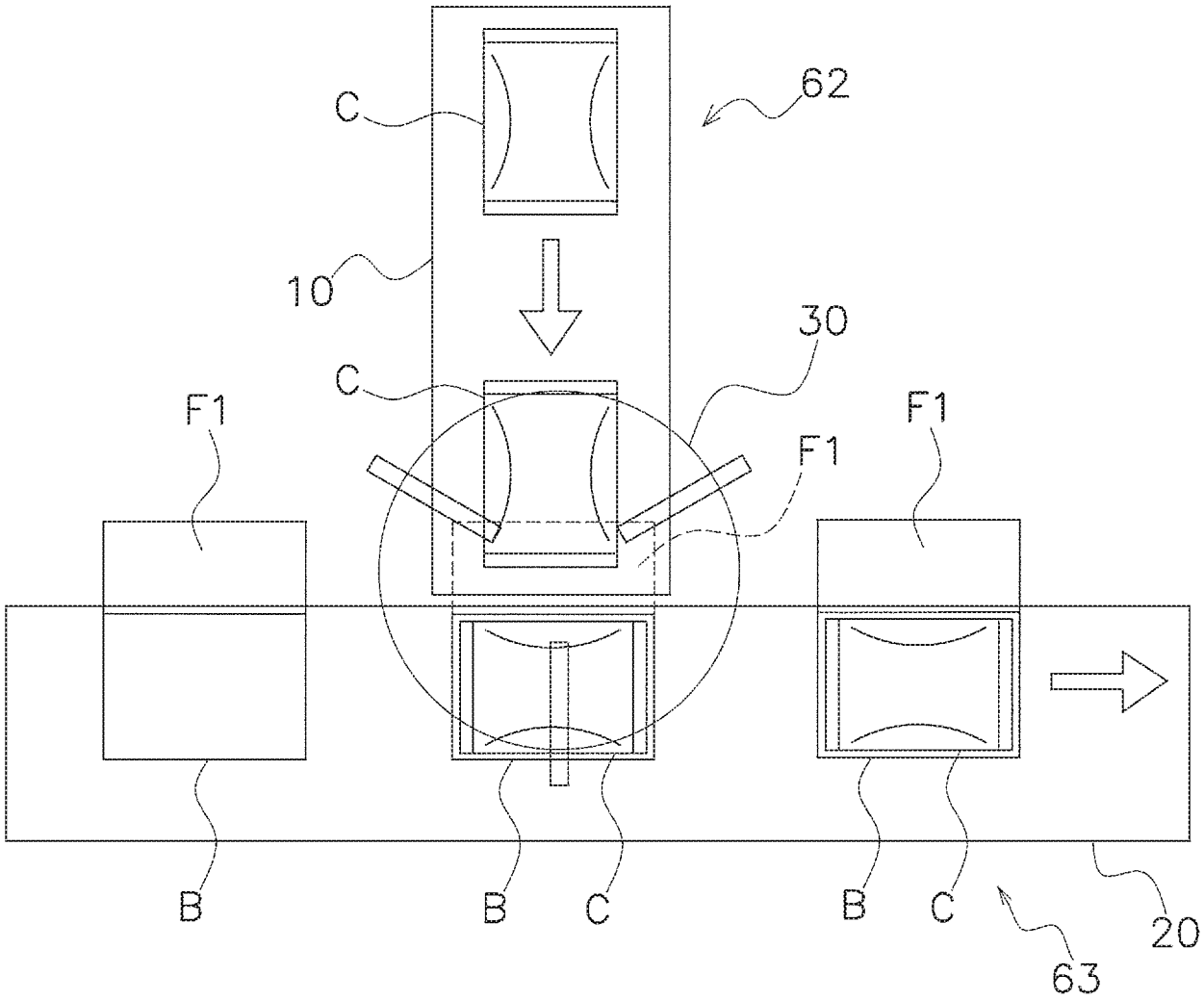
FIG. 15 is a plan view schematically showing the configuration of the box packing unit 60 in example modification B.

FIG. 15 is a plan view schematically showing the configuration of the box packing unit 60 in this example modification. In FIG. 15, the conveyance direction of the articles C on the first conveyor 10 and the conveyance direction of the cardboard boxes B on the second conveyor 20 are orthogonal to each other. The parallel link robot 30 performs the box packing operation in which it takes hold of the articles C on the first conveyor 10 and carries them into the cardboard boxes B conveyed thereto by the second conveyor 20.

The conveyor-side cover flap F1 of the cardboard box B on the second conveyor 20 is folded open to the outside of the upper opening TC by the flap folding mechanism 40. Furthermore, the conveyor-side cover flap F1 that has been folded open passes under the placement surface of the first conveyor 10. Specifically, while the second conveyor 20 is conveying the cardboard box B in the conveyance direction, the conveyor-side cover flap F1 of the cardboard box B passes under the first conveyor 10.

In this example modification also, the box packing apparatus 100 can reduce the vertical stroke of the article C held by the parallel link robot 30 by folding open at least the conveyor-side cover flap F1 with the flap folding mechanism 40. Furthermore, the box packing apparatus 100 can reduce the horizontal stroke of the article C held by the parallel link robot 30 by conveying the cardboard box B in such a way that the conveyor-side cover flap F1 passes under the placement surface of the first conveyor 10. Consequently, the box packing apparatus 100 can efficiently carry the article C into the cardboard box B using the parallel link robot 30.

In this example modification, as described in example modification A, the flap folding mechanism 40 may also fold open at least one of the two cover flaps F2 and F4 located on both adjacent sides of the conveyor-side cover flap F1. Because of this, the box packing apparatus 100 can further reduce the horizontal stroke of the article C held by the parallel link robot 30, so it can more efficiently carry the article C into the cardboard box B using the parallel link robot 30.

(5-3) Example Modification C

The box packing apparatus 100 may be further equipped with a first flap regulating member. The first flap regulating member is a member for maintaining a state in which the cover flap F1 to F4 that has been folded open by the flap folding mechanism 40 is folded open to the outside of the upper opening TC 90 degrees or more with respect to the vertical direction.

Figure 16:
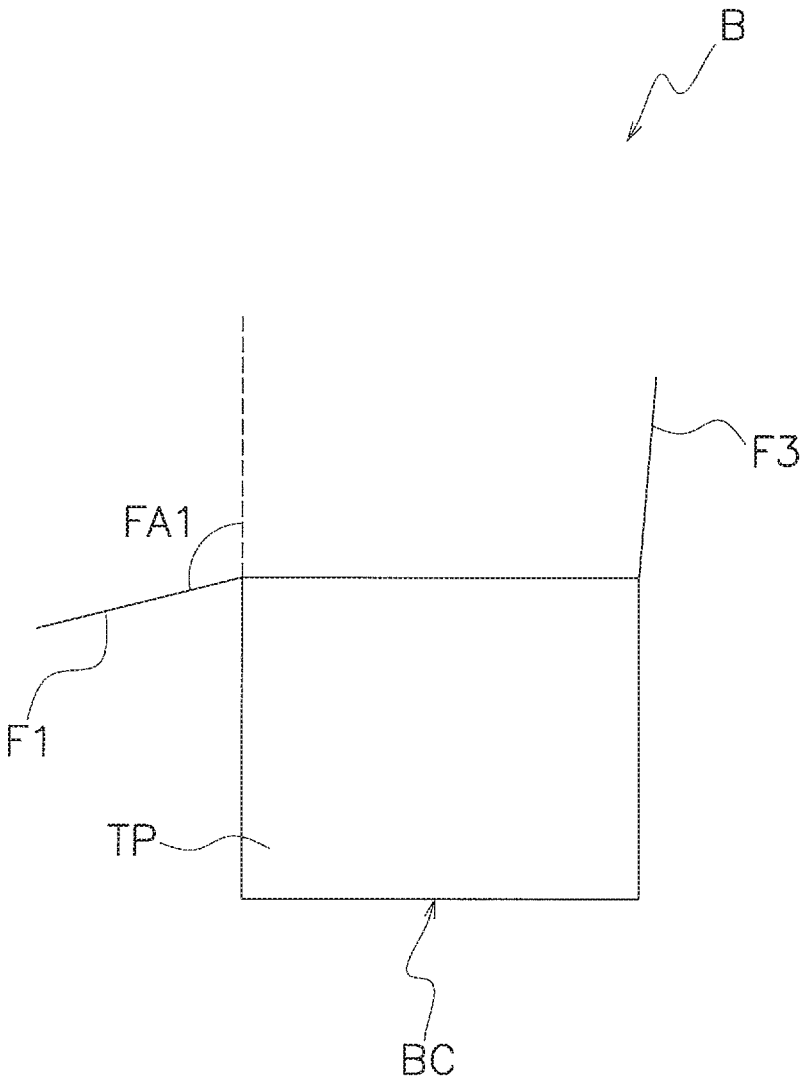
FIG. 16 is a drawing for describing a first flap regulating member in example modification C.

FIG. 16 is a drawing for describing the effect of the first flap regulating member. In FIG. 16, the cover flaps F2 and F4 are omitted. In FIG. 16, the first flap regulating member maintains a state in which the conveyor-side cover flap F1 of the cardboard box B being conveyed on the second conveyor 20 is folded open. FIG. 16 is a drawing in which the cardboard box B is seen along the conveyance direction. The conveyor-side cover flap F1 is folded open toward the outside of the upper opening TC. In FIG. 16, a first fold angle FA1 is the angle between the vertical direction indicated by the dashed line and the conveyor-side cover flap F1. The first flap regulating member regulates the position of the conveyor-side cover flap F1 in such a way that the first fold angle FA1 becomes 90 degrees or more.

In this example modification, because of the first flap regulating member, the height position of the upper end of the conveyor-side cover flap F1 is the same as, or lower than, that of the upper opening TC. For that reason, a situation where the conveyor-side cover flap F1 that has been folded open once by the flap folding mechanism 40 returns to normal so that the upper end of the conveyor-side cover flap F1 becomes higher than the upper opening TC is prevented. If the upper end of the conveyor-side cover flap F1 is higher than the upper opening TC, the vertical stroke of the article C held by the parallel link robot 30 becomes longer by an amount equal to the vertical direction dimension of the conveyor-side cover flap F1. Consequently, in this example modification, the box packing apparatus 100 can effectively reduce, with the first flap regulating member, the vertical stroke of the article C held by the parallel link robot 30.

Furthermore, in this example modification, the first flap regulating member may, as needed, also be a member for maintaining a state in which the cover flaps F2 to F4 besides the conveyor-side cover flap F1 are folded open to the outside of the upper opening TC. For example, in example modification A, a first flap regulating member for maintaining a state in which the downstream-side cover flap F2 and the upstream-side cover flap F4 are folded open may be used.

The specific configuration of the first flap regulating member is not particularly limited. For example, the first flap regulating member for maintaining a state in which the conveyor-side cover flap F1 is folded open may be a rod-like member that extends in the conveyance direction and is for holding the upper end portion of the conveyor-side cover flap F1.

(5-4) Example Modification D

The box packing apparatus 100 may be further equipped with a second flap regulating member. The second flap regulating member is a member for preventing a state in which the opposite-side cover flap F3 is folded open 30 degree or more with respect to the vertical direction. The opposite-side cover flap F3 is the cover flap F3 located in the farthest position from the first conveyor 10 when it has been folded open to the outside of the upper opening TC, and is the cover flap F3 located across the upper opening TC on the opposite side of the conveyor-side cover flap F1.

Figure 17:
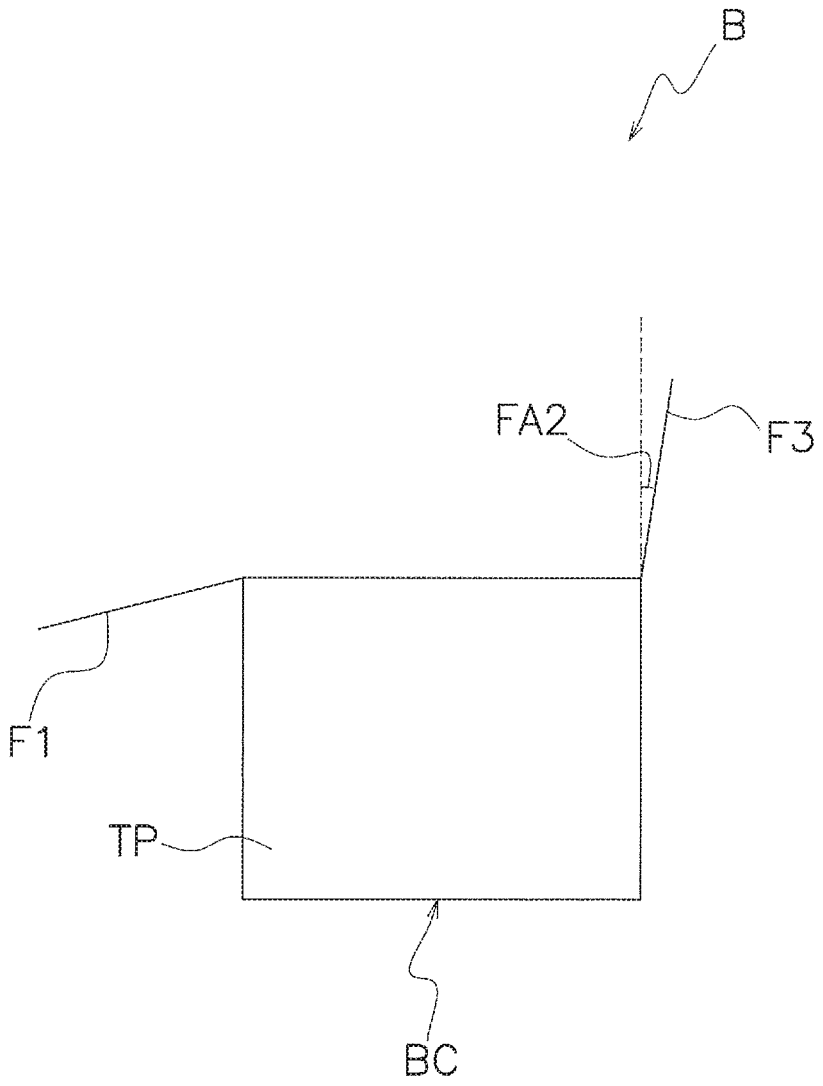
FIG. 17 is a drawing for describing a second flap regulating member in example modification D.

FIG. 17 is a drawing for describing the effect of the second flap regulating member. In FIG. 17, the cover flaps F2 and F4 are omitted. In FIG. 17, the second flap regulating member prevents a state in which the opposite-side cover flap F3 of the cardboard box B conveyed on the second conveyor 20 is folded open 30 degrees or more with respect to the vertical direction. FIG. 17 is a drawing in which the cardboard box B is seen along the conveyance direction. The opposite-side cover flap F3 is not folded open 30 degrees or more toward the outside of the upper opening TC. In FIG. 17, a second fold angle FA2 is the angle between the vertical direction indicated by the dashed line and the opposite-side cover flap F3. The second flap regulating member regulates the position of the opposite-side cover flap F3 in such a way that the second fold angle FA2 does not become 30 degrees or more.

In this example modification, because of the second flap regulating member, the opposite-side cover flap F3 is substantially always in an upright state. If the opposite-side cover flap F3 is folded open and inclined 30 degrees or more with respect to the vertical direction, there is the concern that the problems described below will occur.

If the moving speed of the article C held by the parallel link robot 30 is increased in order to improve the efficiency with which the parallel link robot 30 packs the article C, there is the concern that the article C being sucked by the sucking and holding unit 38 will come free from the sucking and holding unit 38. However, even in this case, if the opposite-side cover flap F3 is upright, there is the possibility that the article C that has come free from the sucking and holding unit 38 will be thrown from the first conveyor 10 toward the second conveyor 20, hit the opposite-side cover flap F3, and fall into the cardboard box B. Furthermore, if the opposite-side cover flap F3 is upright and some of the suction of the article C in the sucking and holding unit 38 does not hold, there is the possibility that the article C will be sucked again by the sucking and holding unit 38 as a result of the article C hitting the opposite-side cover flap F3. Consequently, in this example modification, by regulating the angle of the opposite-side cover flap F3 with the second flap regulating member, the box packing apparatus 100 can reduce the occurrence of problems such as the article C dropping outside the cardboard box B or the article C coming free from the parallel link robot 30.

The specific configuration of the second flap regulating member is not particularly limited. For example, the second flap regulating member for maintaining a state in which the opposite-side cover flap F3 is upright may be a rod-like member that extends in the conveyance direction and is for holding the upper end portion of the opposite-side cover flap F3. Furthermore, the specific numerical range of the second fold angle FA2 limited by the second flap regulating member is not particularly limited. For example, the second flap regulating member may also regulate the position of the opposite-side cover flap F3 in such a way that the second fold angle FA2 does not become 15 degrees or more.

(5-5) Example Modification E

In the above embodiment, the first conveyor 10 continuously conveys the articles C and the second conveyor 20 continuously conveys the cardboard boxes B. However, depending on various conditions, the box packing apparatus 100 may also intermittently convey the articles C with the first conveyor 100 and intermittently convey the cardboard boxes B with the second conveyor 20. The various conditions are, for example, the number and dimensions of the articles C supplied per unit of time by the first conveyor 10.

REFERENCE SIGNS LIST

10 First Conveyor
30 Parallel Link Robot
40 Flap Folding Mechanism
100 Box Packing Apparatus
B Cardboard Boxes (Boxes)
C Articles
F1 to F4 Cover Flaps
TC Upper Opening

The invention claimed is:

1. A box packing apparatus comprising:

a first conveyor that conveys an article in a conveyance direction;

a second conveyor that conveys a box that has an upper opening, the second conveyor arranged so as not to overlap with the first conveyor when viewed along a vertical direction;

a parallel link robot that takes hold of the article on the first conveyor and carries it into the box on the second conveyor; and a metal member positioned upstream from the parallel link robot;

the apparatus adapted to fold open to the outside of the upper opening at least one of plural cover flaps of the box that are located around the upper opening by operation of the metal member, the metal member positioned upstream from the parallel link robot in the conveyance direction to fold open to the outside of the upper opening a conveyor-side cover flap that is the cover flap located in the horizontally closest position to the first conveyor when it has been folded open to the outside of the upper opening, wherein the parallel link robot moves the article and carries the article into the box at a height position above the cover flap that has been folded open and lower than upper ends of the other cover flaps that are not folded open.

2. The box packing apparatus according to claim 1, wherein the metal member is positioned to also fold open to the outside of the upper opening at least one of the two cover flaps located on both adjacent sides of the conveyor-side cover flap.

3. The box packing apparatus according to claim 1, wherein the second conveyor is adapted to convey the box in such a way that the vertical position of the conveyor-side cover flap that has been folded open by the metal member is the same as, or lower than, the vertical position of the article being conveyed by the first conveyor.

4. The box packing apparatus according to claim 3, wherein the first conveyor has a conveyance surface on which the article is placed, and the second conveyor conveys the box in such a way that the conveyor-side cover flap is positioned under the conveyance surface.

5. The box packing apparatus according to claim 1, further comprising a first flap regulating member that maintains a state in which the cover flap that has been folded open by the metal member is folded open to the outside of the upper opening 90 degrees or more with respect to the vertical direction.

6. The box packing apparatus according to claim 1, further comprising a second flap regulating member that prevents a state in which the cover flap located in the farthest position from the first conveyor when it has been folded open to the outside of the upper opening is folded open 30 degrees or more with respect to the vertical direction.

7. The box packaging apparatus according to claim 1, wherein the first and second conveyors are spaced apart in a horizontal direction that is perpendicular to the conveyance direction.

* * * * *